US007583031B1

(12) United States Patent
Sansone

(10) Patent No.: US 7,583,031 B1
(45) Date of Patent: Sep. 1, 2009

(54) PAPI 1 STYLE A TILT SYSTEM

(75) Inventor: John M. Sansone, Oak Lawn, IL (US)

(73) Assignee: Multi Electric Mfg Inc., Chicago, IL (US)

( * ) Notice: Subject to any disclaimer, the term of this patent is extended or adjusted under 35 U.S.C. 154(b) by 832 days.

(21) Appl. No.: 11/312,198

(22) Filed: Dec. 20, 2005

(51) Int. Cl.
*H05B 37/00* (2006.01)

(52) U.S. Cl. ..... 315/132; 315/133; 315/136

(58) Field of Classification Search ..... 315/129, 315/133, 132, 136, 130; 340/953, 955, 642, 340/643
See application file for complete search history.

(56) References Cited

U.S. PATENT DOCUMENTS 3,143,729 A * 8/1964 Power ..... 340/642
3,735,339 A * 5/1973 Knudson ..... 340/953
* cited by examiner

*Primary Examiner*—David Hung Vu
(74) *Attorney, Agent, or Firm*—Nicholas A. Camasto

(57) ABSTRACT

A Style A PAPI system comprises a plurality of identical lamp housing assemblies, each with one or more lamps and each housing assembly including a tilt circuit. A master control includes a microcontroller that supplies an inverted 1 KHz, 50% duty cycle pulse signal to each tilt circuit through a corresponding blocking diode. Each of the tilt circuits includes an optical pendulum tilt switch that responds to tilting of the housing assembly. DC power is developed in each tilt circuit from one phase of the pulse signal. A pair of steering diodes and a voltage divider network enable return pulses to be supplied back to the microcontroller via the same wires that deliver the pulse train. The returned pulses exhibit different voltages corresponding to tilt and no tilt conditions of the tilt switch. Visual indications of the status of each tilt circuit are presented at the tilt circuits and at the master control. The microcontroller disables all of the lamps in the system unless a no tilt voltage is received from every lamp housing assembly.

10 Claims, 2 Drawing Sheets

(TERM A)

(TERM B)
TO RELAYS 16
μC
T1 T2
12V
0V
-12V
HIGH2
0-1V
5-6V
TILT
NO TILT
V2
A
B
30
31
25
28
27a
27b
27c
27d
32
33
34

PAPI 1 STYLE A TILT SYSTEM

BACKGROUND OF THE INVENTION AND PRIOR ART

The present invention relates generally to Precision Approach Path Indicator (PAPI) visual guidance systems for aiding pilots in landing an aircraft. Specifically, the PAPI system defines a desired vertical approach angle to a runway and indicates to the pilot, via colored lights, whether the angle of approach of his aircraft to the runway is within the desired approach angle. The colored lights are produced in a number of Lamp Housing Assemblies (LHAs), as will be described below. The Federal Aviation Administration (FAA) establishes the standards for PAPI systems in the United States, whereas the standards for foreign PAPI systems may differ. Therefore it should be understood that, while the present invention is described with respect to the FAA endorsed systems, its application should not be considered as limited to FAA endorsed systems.

The components in an FAA Style B PAPI system are powered by the well-known and widely used constant alternating current (AC) loop employed in most of the world's airport lighting systems, whereas the components in an FAA Style A PAPI system are powered in parallel, directly from utility line power. In any PAPI system there are a number of important considerations, among them being: power consumption; number and type of lamps; size of the Lamp Housing Assemblies (LHAs); system reliability; ease of installation and service; safety with respect to exposed wiring and high voltages; ease of detection and identification of lamp/housing problems; environmental impact of components used; and minimization of the number of wires and interconnections.

The PAPI system generally comprises an array of two or more LHAs, each of which may contain two or three individual lamps. The LHAs are located adjacent the side of a runway and precisely aimed to define a correct vertical approach angle for guiding an incoming aircraft. Generally, each LHA is fitted with an optical filter to present a white light when the aircraft is too high, i.e., above the correct approach angle, and a red light when the aircraft is too low or below the correct approach angle. When the aircraft is too high, all of the LHAs are seen as white lights, when the aircraft is too low, all of the LHAs are seen as red lights and when the aircraft is within the correct approach angle, one-half of the LHAs in the array present a white light and one-half present a red light. The PAPI system usually comprises either two LHAs or four LHAs, with each LHA having either two lamps or three lamps. A two LHA system will therefore show: two red lights when the aircraft is too low; one white and one red light for a correct approach; and two white lights when the aircraft is too high. A four LHA system will also indicate intermediate positions within the correct approach angle. Thus the light indications will be: four red for too low; one white and three red for slightly low; two white and two red for correct approach angle; three white and one red for slightly high; and four white for too high.

The PAPI system also includes a tilt detection arrangement and tilt switch control circuitry for disabling the entire LHA array should the physical attitude or position of any of the LHAs be displaced by a predetermined amount for a predetermined time. This is necessary since the color of the light seen by the pilot could be erroneous and create a potentially hazardous situation should an LHA position be disturbed sufficiently to change its aiming. The choice of PAPI system selected is determined by a number of factors, such as airport size and location, traffic density, economics and the like. For example, some airport installations use multiple PAPI systems located at differing distances (touch down points) along the runway to accommodate aircraft having different landing requirements. The present invention is useful in all PAPI Style A systems.

Current state-of-the-art FAA Style A PAPIs supplied by Multi Electric Mfg. Inc., the assignee of the present invention, include two or more LHAs, each of which is mounted above ground adjacent to the runway and connected to a master control via underground conduit or buried cabling. It will be appreciated that a minimum number of wires and connection points in the PAPI system is a desirable objective with respect to cost, installation and maintenance. Also, it is desirable to minimize the amount of above-ground equipment to avoid damage to or from vehicles and aircraft. The LHAs are connected through break-away type connectors that are designed to readily separate in the event of contact with a moving object or vehicle. The connectors are also poled to minimize exposure of high voltages in the event of a connector separation.

The system of the invention uses optical pendulum tilt switches that require a power connection for a light-emitting diode (LED) and a signal connection for a photo transistor detector which, but for the invention, would undesirably add to the number of wires and connections. The arrangement provides a visual indication of a tilt condition, identifying the particular LHA or LHAs involved, at both the master control and the LHA, reduces system cost and complexity and enhances system manufacture, installation and service.

SUMMARY OF THE INVENTION

The present invention PAPI Style A system is characterized by a microprocessor controlled optical pendulum tilt switch arrangement having a multiplexed power and signal line resulting in a minimal number of wires.

OBJECTS OF THE INVENTION

A principle object of the invention is to provide a novel PAPI Style A system.

Another object of the invention is to provide a PAPI Style A system of greater simplicity and lower cost than the prior art.

A feature of the invention is the provision of a tilt arrangement incorporating a multiplexed power and signal line in a PAPI Style A system.

BRIEF DESCRIPTION OF THE DRAWINGS

These and other objects features and advantages of the invention will be apparent upon reading the following description in conjunction with the drawings in which.

DESCRIPTION OF THE PREFERRED EMBODIMENT

Figure 1:
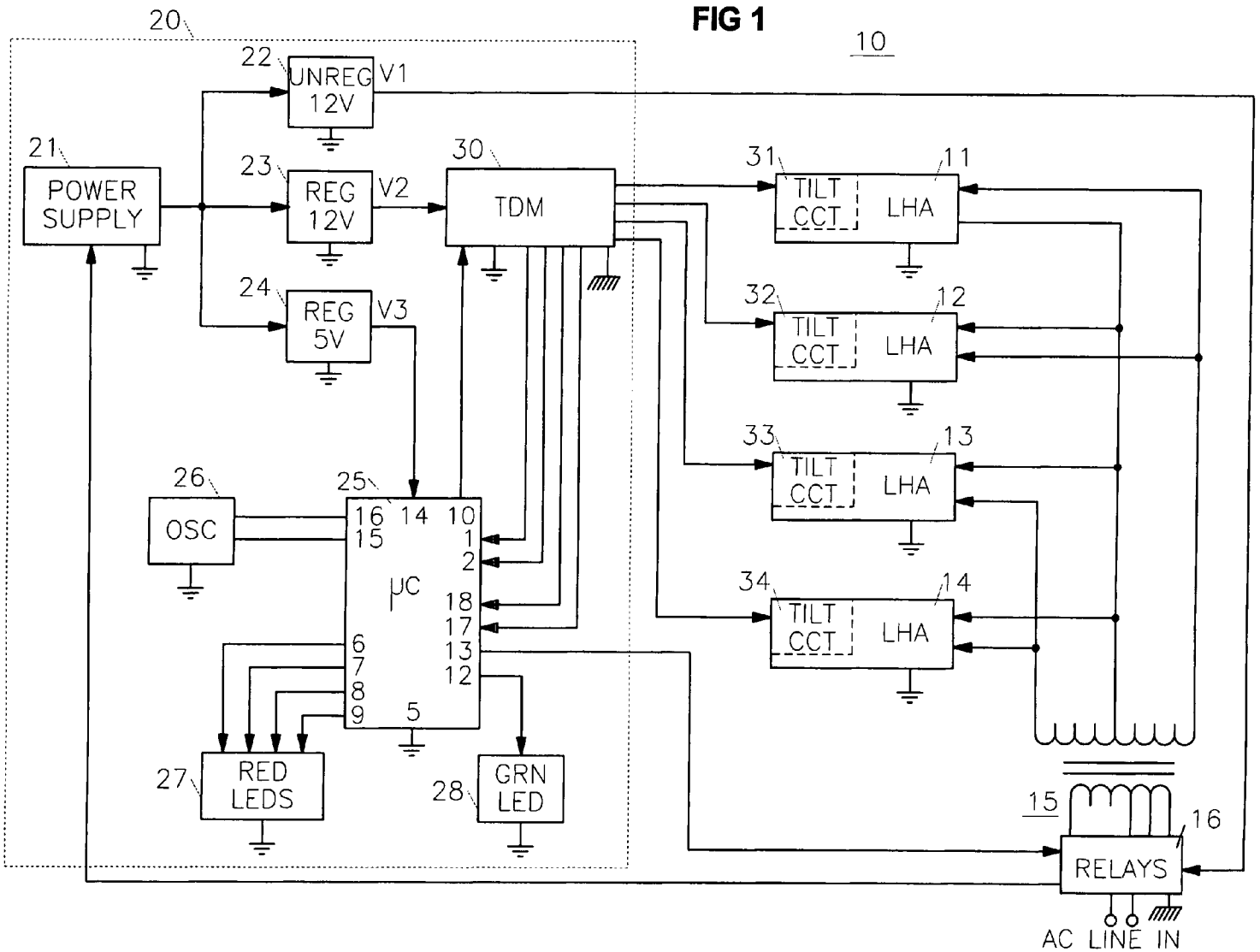
FIG. 1 is a block diagram of a PAPI Style A system incorporating the invention.

Referring to FIG. 1, a PAPI Style A system 10, constructed in accordance with the invention, includes four identical LHAs 11, 12, 13, and 14. Each LHA includes a plurality of lamps and suitable lenses (not shown) for displaying either a white light or a red light, depending upon the vertical viewing angle, to an approaching aircraft, as discussed above. A power transformer 15, having a center-tapped secondary winding and a multiple tap primary winding, is connected to a conventional AC source of power through a block 16, labeled Relays. The lamps in the LHAs are powered from the secondary winding of transformer 15 and may have their intensity adjusted, and be turned on and off by operation of one or more relays (not shown) in block 16. Details of these operations are not disclosed as they have no bearing on the present invention.

A master control, indicated by the components within the dotted-line box 20, includes a DC power supply 21 that is energized from block 16. Power supply 21, in turn, supplies a block 22 for producing an unregulated 12 volts output V1, a block 23 for producing a regulated 12 volts output V2 and a block 24 for producing a regulated 5 volts logic voltage output V3. A microcontroller 25 is energized by voltage V3 (at pin 14) and controlled by an oscillator 26 (at pins 15,16). Microcontroller 25 has an output (10) coupled to a time division multiplex arrangement (TDM) 30, four outputs (6-9) for controlling red LEDs 27, an output (12) for controlling a green LED 28 and an output (13), coupled to block 16, for turning the LHAs on and off. TDM 30 provides four inputs to microcontroller 25 (at pins 1,2 and 17,18) and four outputs, one each to four tilt circuits 31, 32, 33 and 34. A tilt circuit is included in an associated one of the LHAs as indicated by the dashed lines.

A tilt condition results (and a tilt indication is generated) when any of the LHAs in the system experiences a predetermined magnitude of change in its physical orientation. The criteria for generating a tilt indication may be established by the airport operator or other controlling authority so that temporary disruptions of orientation due, for example to strong wind gusts or the like, do not result in disablement of the PAPI system. Since a physically displaced LHA may yield erroneous information as to the desired descent angle for an incoming airplane, all of the lamps are disabled in response to a tilt condition occurring in any of the LHAs. The system is automatic and should a tilt condition be removed, operation of the LHAs returns to normal.

Figures 2, 3, 4:
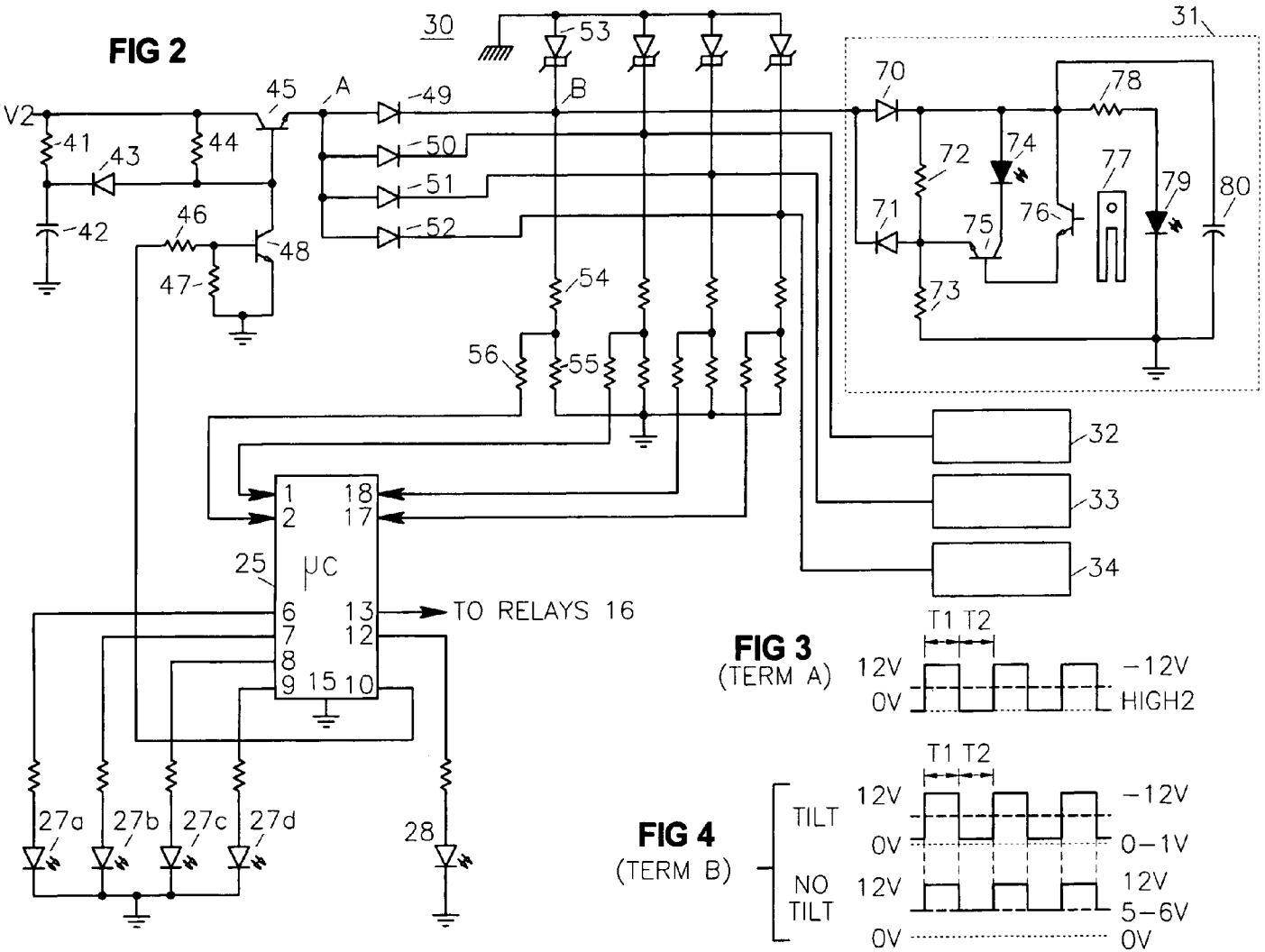
FIG. 2 is a circuit diagram of the tilt arrangement portion of FIG. 1.
FIG. 3 illustrates the pulse voltage developed at terminal A.
FIG. 4 illustrates the voltages produced at terminal B under "tilt" and "no tilt" conditions.

Referring to FIG. 2, the LEDs are shown as red LEDs 27*a*-27*d* and a green LED 28 that are resistively connected to pins 6-9 and 12, respectively, of microcontroller 25. Regulated 12 volts DC voltage V2 is supplied to one end of resistors 41 and 44 and to the collector of a switching transistor 45, the emitter of which feeds a terminal A. The other end of resistor 44 is connected to: the base of transistor 45; the collector of a step up and inverter transistor 48; and the anode of a diode 43. The cathode of diode 43 is connected to the other end of resistor 41 and to circuit ground, through a capacitor 42. It will be observed that the circuit grounds of the system are isolated from the earth ground as indicated by the different symbols used. Unless otherwise noted, the term ground refers to a circuit ground.

The base of transistor 48 is connected to the junction of a pair of resistors 46 and 47, with the other end of resistor 46 being connected to pin 10 of microcontroller 25 and the other end of resistor 47 being connected to the emitter of transistor 48 and to ground. Microcontroller 25 generates a 1 KHz, 5 volts DC, 50% duty cycle pulse train at pin 10, which is stepped up to 12 volts DC and inverted by transistor 48. Transistor 48 causes transistor 45 to conduct, thus producing a corresponding pulse train at terminal A (as best seen in FIG. 3).

Terminal A is coupled to the anodes of blocking diodes 49, 50, 51 and 52, the cathodes of which are connected to tilt circuits 31, 32, 33 and 34, respectively. Since the individual circuits in time division multiplex arrangement 20 that supplies the tilt circuits 31-34 are identical, only the first will be described in detail, it being understood that the discussion applies to the others as well. The cathode of blocking diode 49 is connected to a terminal B to which is also connected one terminal of a Transorb 53 and a resistor 54. The other terminal of Transorb 53 is connected to earth ground and the other terminal of resistor 54 is connected to ground through a resistor 55. The junction of resistors 54 and 55 is connected to pin 2 on microcontroller 25 via a resistor 56. Transorb 53 serves to suppress transient voltages, and the combination of resistors 54-56 form a voltage divider arrangement for converting the potential at terminal B to logic values for application to microcontroller 25. It will be appreciated that the Transorbs and voltage divider networks for the other tilt circuits are connected to corresponding pins of microcontroller 25.

Terminal B is connected a pair of oppositely poled steering diodes in tilt circuit 31, i.e., to the junction of the anode of a diode 70 and the cathode of a diode 71. The cathode of diode 70 is connected to: a bypass resistor 72; the anode of a green light-emitting LED 74; the collector of a tilt sensor photo detector transistor 76; a current limiting resistor 78; and, through a relatively large (101*f*) filter capacitor 80, to ground. The other end of bypass resistor 72 is connected to the junction of the anode of diode 71, the emitter of a driver transistor 75 and, through a resistor 73, to ground. Bypass resistor 72 and resistor 73 will be seen to form a voltage divider network between the cathode of steering diode 70 and ground. The other terminal of LED 74 is connected to the collector of driver transistor 75. An LED 79 is coupled between the other end of current limiting resistor 78 and ground. A slotted pendulum 77, which together with LED 79 and photo detector transistor 76 forms a tilt switch, is pivotally secured to its associated LHA 11. The slot in pendulum 77 normally permits light from LED 79 to pass and impinge on photo detector transistor 76, causing it to conduct. It will be appreciated that LED 79 and photo detector transistor 76 are securely affixed to LHA 11 and therefore move along with the LHA, whereas pendulum 77 swings on the LHA to maintain its vertical orientation. Should the LHA move sufficiently, the light beam between LED 79 and photo detector transistor 76 will no longer pass through the slot in pendulum 77, causing photo detector transistor 76 to cease conduction.

Thus the optical pendulum tilt switch develops an indication whenever the physical attitude of the LHA has been altered by a predetermined amount, i.e., to the extent that it no longer can be relied upon to accurately define the correct vertical approach angle. This change, signifying the possible occurrence of a tilt condition, is sensed by the microcontroller, which after a predetermined time interval that is selected to minimize spurious operations, verifies that a tilt condition exists and generates a signal to disable all of the lamps in all of the LHAs Under normal operating conditions, when LHA 11 is not in a tilt condition, transistor 75 is conducting and green LED 74 is illuminated. The same holds true for the other LHAs 12-14 and their corresponding tilt circuits 32-34. Also, green LED 28 in master control 20 is illuminated (from pin 12 of microcontroller 25) when none of the LHAs are in a tilt condition. Therefore, the master control 20 and the individual LHAs illuminate a green LED when the PAPI system is normal, i.e., not in tilt. As will be seen, should an LHA experience a tilt condition, the green LED in the master control and in the LHA in tilt will be extinguished and the red LED in the master control corresponding to the LHA in tilt will be illuminated, thus simplifying servicing of the system. Simultaneous tilt of more than one LHA results in extinguishing the green LED in the master control and the affected LHAs and illumination of the corresponding red LEDs in the master control. Master control 20 disables the lamps in all of the LHAs when microcontroller 25 detects a tilt condition in one or more of the LHAs and also whenever the appropriate voltages from the tilt circuits are not returned, regardless of the cause. Thus, a broken wire or a defective tilt circuit will result in disabling all of the LHAs. Thus the PAPI system is constantly supervised, which is an important safety feature.

Tilt circuit operation will be described for tilt circuit 31, it being understood that the other tilt circuits 32-34 operate in a similar manner. The stepped up and inverted 1 KHz, 50% duty cycle pulse from microcontroller 25 at terminal A passes through blocking diode 49 and appears at terminal B, to which tilt circuit 31 is connected. Current from this pulse passes through diode 70 and "pump" charges capacitor 80 to approximately 12 volts DC. Since LED 79 and current limiting resistor 78 are connected in parallel with capacitor 80, LED 79 is energized and emits light as long as the system is powered on and capacitor 80 is charged. In a no tilt condition, this light passes through the slot in pendulum 77 and impinges on photo detector transistor 76, causing it to conduct. Driver transistor 75 is activated causing the illumination of green LED 74. Conduction of driver transistor 75 diverts current from bypass resistor 72 causing the voltage at the anode of diode 71 (terminal B) to rise to the voltage across capacitor 80. (In a tilt condition, transistor 75 is cut off and the voltage at the junction of bypass resistor 72 and resistor 73 is much lower.)

Each time the inverted pulse voltage at terminal A swings low, the voltage at terminal B (the anode of diode 71) is sampled by microcontroller 25. (When the inverted pulse voltage at terminal A swings high, the anode voltage of diode 71 is higher than its cathode voltage and it is reverse biased. Blocking diode 49 prevents the incoming pulses from TDM 30 in the master control from affecting the pulses sampled by microcontroller 25. It will also be appreciated that the signals returned to microcontroller 25 are divided down to a 5 volts DC logic scale by the voltage divider arrangement comprising resistors 54 and 55. Since the pulses at terminal A are 180° out of phase with the pulses sampled by microcontroller 25, when microcontroller 25 outputs the TDM signal (at its pin 10) it checks the incoming signals (at pins 1,2 and 17,18). Should a logic low return signal be received at one or more of the pins (for the predetermined amount of time) microcontroller 25 illuminates red LED 27*a* (via pin 6), disables green LED 28 (via pin 12) and sends a signal to block 16 (via pin 13) to operate the relays for disabling the lamps in all of the LHAs. Each of the other tilt circuits operates in the same manner and each is simultaneously monitored for a tilt condition, with a tilt signal in any of the LHAs resulting in all of the lamps in all of the LHAs being extinguished.

FIG. 3 shows the waveform at terminal A and FIG. 4 illustrates the waveforms at terminal B, for both a tilt and a no tilt condition. Bear in mind that these waveforms are displaced by 18° from the TDM signal (not shown). T1 and T2 indicate successive periods of the inverted 1 KHz, 50% duty cycle pulse train from microcomputer 25. Because of the inversion, period T2 corresponds to the positive cycle of the TDM signal from pin 10 of microcomputer 25. During interval T2, microcontroller 25 samples the voltage at terminal B. The waveforms indicate a logic low (indicative of a tilt condition) of approximately 0 to 1 volts, and a logic high (indicative of a no tilt condition) of around 5 to 6 volts.

To recapitulate, for a normal no tilt condition, transistor 76 conducts, effectively shorting out bypass resistor 72, thus causing diode 71 to conduct, raising the voltage on terminal B to approximately the voltage across capacitor 80 and reverse biasing diode 49. This high voltage is converted to logic levels by voltage divider action and detected as a logic high by microprocessor 25. For a tilt condition, transistor 76 is switched off allowing the voltage divider network; consisting of bypass resistor 72 and resistor 73, to place a lower voltage on the anode of diode 71. Diode 49 is still reverse biased and this lower voltage, when converted to logic levels, is detected as a logic low by microprocessor 25. Note that if the tilt circuit in the LHA should be disconnected the voltage from diode 71 will not be present and a logic low will be detected by microcontroller 25.

What has been described is a novel PAPI Style A system of improved cost and efficiency and that is more readily and accurately installed and maintained. It is recognized that numerous changes in the described embodiment of the invention will occur to those skilled in the art, without the need for inventive skill. Therefore, the scope of the invention is to be limited only as defined in the claims.

The invention claimed is:

1. A tilt arrangement for a Style A PAPI lighting system comprising:

a lamp housing assembly;

a tilt circuit, including a tilt switch, in said lamp housing assembly;

a microcomputer supplying a pulse signal to said tilt circuit;

a charge pump, developing DC power from said pulse signal, for energizing said tilt circuit;

said tilt circuit developing two different voltages for the two phases of said pulse signal responsive to the status of said tilt switch; and said microcomputer determining the status of said tilt switch from said two different voltages.

2. The arrangement of claim 1, further including:

an inverter circuit for inverting said pulse signal from said microcomputer;

a blocking diode coupling said inverted pulse signal to said tilt circuit; and a voltage divider arrangement receiving said two different voltages and returning corresponding logic level signals to said microcomputer.

3. The arrangement of claim 2, wherein said tilt switch includes an LED and a photo detector responsive to said LED; and a driver transistor having its input coupled to said photo detector.

4. The arrangement of claim 3, wherein said tilt circuit further includes:

a voltage divider network supplied with said DC power;

a pair of oppositely poled steering diodes coupled between said blocking diode and said voltage divider network; and the output of said driver transistor being coupled to said voltage divider network.

5. The arrangement of claim 4, wherein said pulse signal has a frequency of approximately 1 KHz and a fifty percent duty cycle.

6. The arrangement of claim 5, wherein said LED and said photo detector are affixed to said lamp housing assembly, and further including:

a pendulum pivotally mounted to said lamp housing assembly and interposed between said LED and said photo detector;

said pendulum having a slot whereby said photo detector receives light from said LED when the physical attitude of said lamp housing assembly is undisturbed; and an indicator LED in circuit with said driver transistor for indicating movement of said lamp housing assembly.

7. In combination:

a style A PAPI system having a plurality of lamp housing assemblies, each including a tilt circuit;

a microcomputer for providing a substantially 1 KHz, fifty percent duty cycle pulse signal to each of said tilt circuits;

a charge pump in each said tilt circuit for developing DC power from said pulse signal for energizing its associated tilt circuit;

each of said tilt circuits providing two different voltages corresponding to the existence of a tilt condition or no tilt condition for its associated lamp housing assembly; and said microcomputer sampling said two different voltages for determining the existence of a tilt condition.

8. The arrangement of claim 7, further including:

an inverter circuit for inverting said pulse signal from said microcomputer;

a plurality of blocking diodes coupling said inverted pulse signal to respective ones of said tilt circuits; and a voltage divider arrangement for receiving said two different voltages from each of said tilt circuits and returning corresponding logic level signals to said microcomputer.

9. The combination of claim 8, wherein said tilt circuits each includes:

a tilt switch;

an LED and a photo detector affixed to said lamp housing assembly, a driver transistor having its input coupled to said photo detector;

a pendulum pivotally mounted to said lamp housing assembly and interposed between said LED and said photo detector;

said pendulum having a slot whereby said photo detector receives light from said LED when the physical attitude of said lamp housing assembly is undisturbed; and an indicator LED in circuit with said driver transistor for indicating movement of said lamp housing assembly.

10. The arrangement of claim 9, wherein each of said tilt circuits includes:

a voltage divider network supplied with said DC power;

a pair of oppositely poled steering diodes coupled between its associated one of said blocking diodes and said voltage divider network; and the output of said driver transistor coupled to said voltage divider network.

* * * * *